US005126077A

United States Patent [19]

Morikawa et al.

[11] Patent Number: 5,126,077

[45] Date of Patent: Jun. 30, 1992

[54] RADIOACTIVE DECONTAMINATION METHOD USING METHYLENE CHLORIDE

[75] Inventors: Kenji Morikawa, Kohshoku; Toshio Tenjin, Yokohama; Yasuo Shimizu, Kohshoku; Akira Doi, Toguramachi, all of Japan

[73] Assignee: Morikawa Sangyo Kabushiki Kaisha, Kohshoku, Japan

[21] Appl. No.: 671,941

[22] Filed: Mar. 19, 1991

[30] Foreign Application Priority Data

Mar. 20, 1990 [JP] Japan ..... 2-71144

[51] Int. Cl.[5] ..... G21F 9/00

[52] U.S. Cl. ..... 252/626; 423/DIG. 20; 134/12; 134/22.19; 134/42; 203/47; 570/262

[58] Field of Search ..... 252/626; 134/12, 22.19, 134/42; 423/DIG. 20; 203/47; 570/262

[56] References Cited

U.S. PATENT DOCUMENTS

| | | | |
|---|---|---|---|
| 2,887,393 | 5/1959 | Winkler et al. | 134/3 |
| 3,361,649 | 1/1968 | Kouter | 203/12 |
| 3,716,616 | 2/1973 | Lin | 423/134 |
| 4,235,600 | 11/1980 | Capella et al. | 8/137 |
| 4,424,079 | 1/1984 | Barabas | 134/4 |
| 4,521,253 | 6/1985 | Barabas | 134/3 |
| 4,537,666 | 8/1985 | Murray et al. | 204/129.95 |
| 4,579,627 | 4/1986 | Brailsford | 156/655 |
| 4,592,856 | 6/1986 | Kobayashi et al. | 252/162 |
| 4,630,625 | 12/1986 | Capella et al. | 134/104 |
| 4,681,705 | 7/1987 | Robertson | 252/631 |
| 4,753,735 | 6/1988 | Figiel | 210/664 |
| 4,917,807 | 4/1990 | Prisco, Jr. et al. | 210/774 |

FOREIGN PATENT DOCUMENTS

| | | | |
|---|---|---|---|
| 2642889 | 8/1990 | France | 252/626 |
| 60-208500 | 10/1985 | Japan . | |
| 1269097 | 11/1986 | Japan | 252/626 |

*Primary Examiner*—Brooks H. Hunt
*Assistant Examiner*—Ngoclan T. Mai
*Attorney, Agent, or Firm*—William L. Klima

[57] ABSTRACT

A radioactive decontamination method for decontaminating a radioactive-contaminated object by using methylene chloride in place of conventionally used hydrocarbon fluoride or perchloroethylene. The radioactive-contaminated object is impacted by methylene chloride solution. Before the impacting, a preparatory step is executed as required in which radioactive contaminant, which is usually radioactive-contaminated epoxy-resin paint layer on a part used in a nuclear facility, is impregnated with methylene chloride solution so as to swell, thus facilitating exfoliation of the contaminant from the object. The methylene chloride solution is filtered and distilled so as to be decontaminated and subjected to a repeated use for impacting the radioactive-contaminated object. Methylene chloride solution exhibits much greater radioactive decontamination effect than solutions of conventional decontamination mediums such as hydrocarbon fluoride and perchloroethylene and is not so polluting as the known decontamination mediums. The decontamination of methylene chloride itself, which is effected through the distillation, can be executed with much smaller electrical power consumption as compared with the case where perchloroethylene is used.

9 Claims, 2 Drawing Sheets

RADIOACTIVE DECONTAMINATION METHOD USING METHYLENE CHLORIDE

BACKGROUND OF THE INVENTION

1. Field of the Invention

The present invention relates to a radioactive decontamination method for removing radioactive contaminants from various portions of a nuclear power station or other nuclear facility, such as devices connected to or disposed around a nuclear reactor, pipes and instruments around the nuclear reactor.

2. Description of the Related Art

Radioactive contaminated parts are produced as a result of running of a nuclear facility such as a nuclear power station. More specifically, such radioactive-contaminated parts are produced in the course of replacement or overhaul of various devices and apparatuses in the nuclear power station. These parts are usually packaged in a drum as they are or after cutting into pieces, and are stored in a suitable place such as an abandoned mine.

The amount of stored contaminated parts increases year by year so that storage places such as waste mines will be fully occupied before long. In order to overcome this problem, there has been attempted to build a storage facility at a location which is located far from living areas. Such attempt, however, has encountered opposition of the local residents, thus causing a social problem.

To avert from this problem, varios inventions have been achieved in the field of radioactive decontamination. These efforts are concentrated to reduce the amounts of contaminated parts to be stored, by removing radioactive contaminants from such parts.

One of such inventions is disclosed in Japanese Patent Publication No. 59-36240. According to the invention disclosed in the above-mentioned patent publication, a decontamination medium such as hydrocarbon fluoride or perchloroethylene is heated in a vessel and is vibrated by a supersonic vibrator, and radioactive-contaminated parts are immersed in the decontamination medium, thereby removing radioactive contaminants from the parts.

This known method, however, has the following disadvantage. Firstly, it is to be understood that both hydrocarbon fluoride and perchloroethylene have a small decontamination ability. In fact, these substances exhibit a much smaller cleaning effect comparing these with the present invention, as will be realized from a comparison test result which will be mentioned later.

Secondly, it is to be understood that both hydrocarbon fluoride and perchloroethylene cause environmental pollution.

As is well known, hydrocarbon fluoride breaks down the ozone layer around the earth so as to form ozone holes. The number of persons suffering from cancers is increasing as a result of ultraviolet rays in the solar light rays which reach the earth through the ozone holes without being absorbed by the ozone layer. For these reasons, nowadays, there is a world-wide movement toward prohibition of use of hydrocarbon fluoride. According to the Montreal agreement by members of the United Nations, the production and use of this substance is to be ceased by the end of this century.

Perchloroethylene also has an effect in causing cancer. This substance is toxic when taken into the human body aurally or through contact with skin. Thus, this substance causes a serious pollution. The allowable maximum concentration of perchloroethylene in the air is 100 ppm. In the U.S.A., production and use of perchloroethylene are planned to be ceased by 1996.

In the removal of radioactive contaminants using perchloroethylene, it is necessary to remove, by distillation, contaminants from the decontamination medium, i.e., from perchloroethylene itself. The removal of radioactive contaminants through distillation consumes large electrical power because of the high boiling point (121.2° C.) of the perchloroethylene.

Usually, suitable organic substances are added as stabilizers to perchloroethylene. The content of such stabilizers, however, are reduced in the course of distillation for the cleaning of perchloroethylene. The use of perchloroethylene having such reduced contents of stabilizers adversely affects metals.

Furthermore, perchloroethylene generally exhibits inferior stability to electromagnetic waves. Perchloroethylene is oxidized by ultraviolet rays so as to be changed into trichloroacethyl chloride. When exposed to solar light for a long time, perchloroethylene is easily changed into trichloroacetate and hydrochloric acid.

Thus, perchloroethylene has a risk to be denaturated as a result of application of $\alpha$-, $\beta$- and $\gamma$-rays radiated from radioactive-contaminated parts.

SUMMARY OF THE INVENTION

In view of the above-described problems of the known arts, an object of the present invention is to provide a radioactive decontamination method which provides a much higher decontamination effect than known methods.

Another object of the present invention is to provide a radioactive decontamination method which does not cause heavy pollution.

Still another object of the present invention is to provide a radioactive decontamination method which enables cleaning of the decontamination medium with a small power consumption, thus offering a high decontamination efficiency.

A further object of the present invention is to provide a radioactive decontamination method in which the decontamination medium has a stable molecular structure so as not to be denaturated in the course of cleaning of the decontamination medium itself.

A still further object of the invention is to provide a radioactive decontamination method in which undesirable denaturation of the decontamination medium caused by radioactive rays from the contaminated parts is suppressed so as to ensure a high stability of decontamination.

To these ends, according to one aspect of the present invention, there is provided a radioactive decontamination method using methylene chloride, comprising the steps of: cleaning a radioactive-contaminated object with a methylene chloride solution so as to remove contaminant from the surface of the object thereby decontaminating the object; further decontaminating the object by means of a chelate solution; filtering the methylene chloride solution containing the contaminant so as to separate the contaminant from the methylene chloride solution; distilling the methylene chloride solution after separation of the contaminant so as to separate any contaminant which has still been dissolved in the methylene chloride solution, thereby decontaminating the methylene chloride solution itself; and subjecting the decontaminated methylene chloride solution to repeated use for cleaning the object.

According to another aspect of the present invention, there is provided a radioactive decontamination method using methylene chloride, comprising the steps of: immersing a radioactive-contaminated object in a methylene chloride solution so as to impregnate contaminant on the surface of the object with the methylene chloride solution; cleaning the object with the methylene chloride solution so as to remove contaminants from the surface of the object thereby decontaminating the object; further decontaminating the object by means of a chelate solution; filtering the methylene chloride solution containing the contaminant so as to separate the contaminant from the methylene chloride solution; distilling the methylene chloride solution after separation of the contaminant so as to separate any contaminant which has still been dissolved in the methylene chloride solution, thereby decontaminating the methylene chloride solution itself; and subjecting the decontaminated methylene chloride solution to repeated use for cleaning the object.

The cleaning of the radioactive-contaminated object is conducted by impacting the object with the methylene chloride solution. The impacting of the object with the methylene chloride solution may be conducted while the object is held in the air or immersed in the methylene chloride solution.

The radioactive-contaminated object to be decontaminated may be pre-treated by sand-blasting or shot-blasting before subjected to the decontamination process.

DESCRIPTION OF THE PREFERRED EMBODIMENTS

Figure 1:
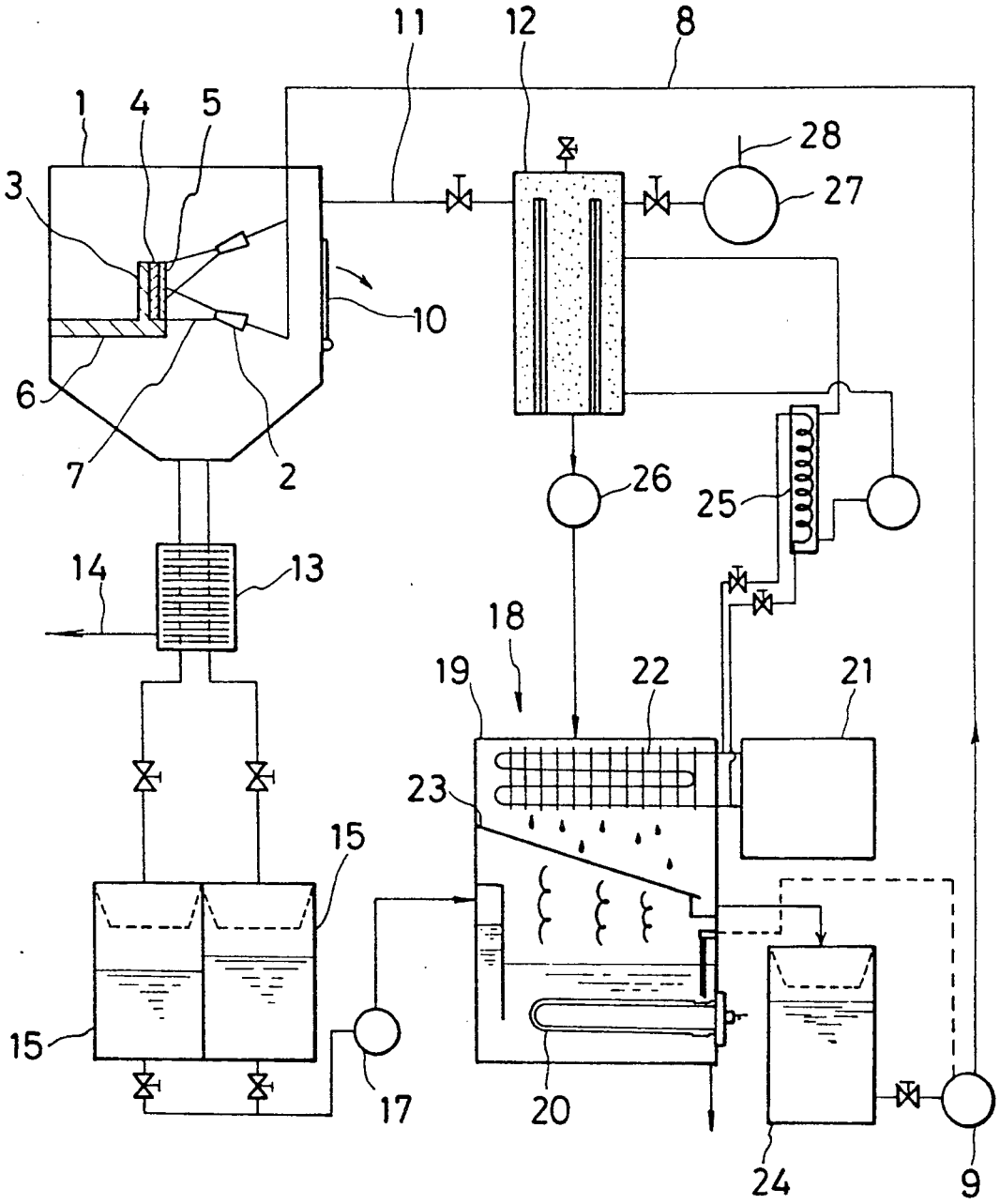
FIG. 1 is a schematic illustration of an apparatus which is employed in carrying out the method of the invention for decontaminating a radioactive contaminated part by means of methylene chloride.
Figure 2:
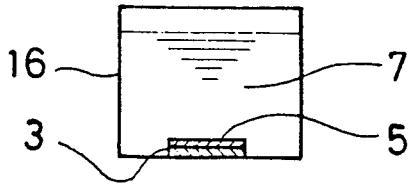
FIG. 2 is an illustration of an apparatus which is used in a preparatory step of decontamination performed by the apparatus shown in FIG. 1.

Referring to FIG. 1, numeral 1 denotes a hermetic decontamination chamber. Nozzle 2 disposed in the decontamination chamber 1 are directed towards a radioactive contaminated part 3 to be decontaminated. The radioactive decontaminated part will be described in more detail. In general, most of component devices in a nuclear facility such as a nuclear power station are coated with epoxy-resin type paints. In the illustrated case, a layer of an epoxy resin paint resides as a contaminant 5 on a metal part 4. Numeral 6 denotes a support for supporting the contaminated part 3 in the decontamination chamber 1. Numeral 7 denotes jets of a methylene chloride solution from the nozzles 2, numeral 8 denotes a communication passage, 9 denotes a high-pressure pump and 10 denotes a lid covering an entrance formed in the wall of the decontamination chamber. Numeral 11 denotes a communication passage leading to an activated-carbon-type adsorption device 12. A filter 13 is connected to the bottom of the decontamination chamber 1 and has a discharge line 14. The filter 13 is connected to tanks 15.

Figure 3:
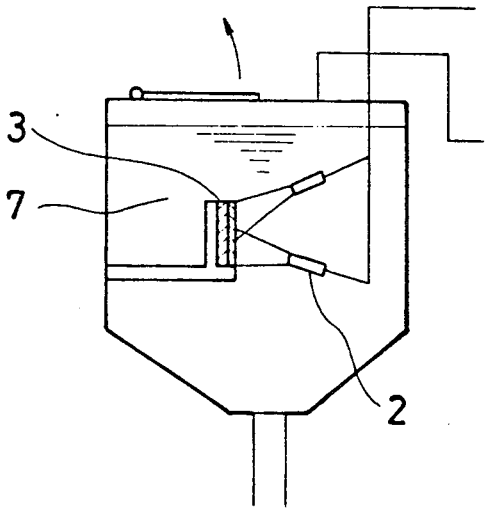
FIG. 3 is an illustration of a part of another example of the apparatus suitable for use in the method of the present invention.

The decontamination chamber 1 may have a construction as shown in FIG. 3. In this case, the nozzles 2 are immersed in a bath of methylene chloride 7 so that the nozzles 2 impacts on the radioactive-contaminated part 3 in the methylene chloride solution 7, in contrast to the apparatus shown in FIG. 1 in which the nozzles impact on the radioactive-contaminated part 3 in the air. The method of the present invention is typically conducted in the following manner, although the method may be such that the radioactive contaminated part 3 is directly impacted by the methylene chloride solution 7 without any pretreatment.

As shown in FIG. 1, the radioactive contaminated part 3 is dipped in the methylene chloride solution 7 filling the decontamination chamber, in advance of the decontaminating operation. Consequently, the contaminant, e.g., epoxy-resin-type paint layer 5, is made to swell as a result of impregnation with the methylene chloride solution, thus facilitating exfoliation of the paint layer. The radioactive-contaminated part 3 is then placed on the support 6 and is impacted by the methylene chloride solution 7 jetted from the nozzles 2.

The aforementioned filter 13 filtrates the methylene chloride solution 7 containing the separated radioactive contaminant 5 so that the radioactive contaminant 5 is separated from the solution so as to be discharged through the discharge line 14. while the methylene chloride solution 7 is discharged to the tanks 15. The methylene chloride solution thus collected is then pumped by a pump 17 into a distillation apparatus 18 which distills the methylene chloride solution 7 thereby decontaminating the methylene chloride solution 7 itself. The distillation apparatus has a distillation chamber 19, a heater 20, a cooling device 21, cooling fins 22, droplet collecting plate 23, and a second tank 24. Numeral 25 designates a cooler for cooling the adsorption device 12 to enable the latter to perform adsorption. A heater, which is used for releasing substances adsorbed by the adsorption device 12, is not shown. In releasing the adsorbed substances, a heated carrier air is supplied to the adsorption device 12 by a device which is not shown and the carrier gas carrying the released substances is cooled by a liquefying device 26 down to a temperature below the boiling point of the carrier air, whereby the carrier air is liquefied to enable collection of the released substances. The adsorption device 12 used in the described apparatus may be of the type which is disclosed in the specification of Japanese Patent Application No. 1-76089 filed at the Japanese Patent Office by the same applicant. Part of the gas which could not be liquefied by the liquefying device 26 is cooled by a solidifying device (not shown) down to a temperature below the solidification temperature of this gas, so as to be solidified. The solidified gas is then heated to become a liquid and then collected. It is thus possible to collect the gas substantially completely. The methylene chloride solution 7, which has been collected by the help of a suitable apparatus (not shown) and decontaminated through the evaporator 18 is supplied to the nozzles 2 of the decontamination chamber 1.

Numeral 27 denotes a blower, while 28 designates a discharge passage for cleaned air.

Figure 4:
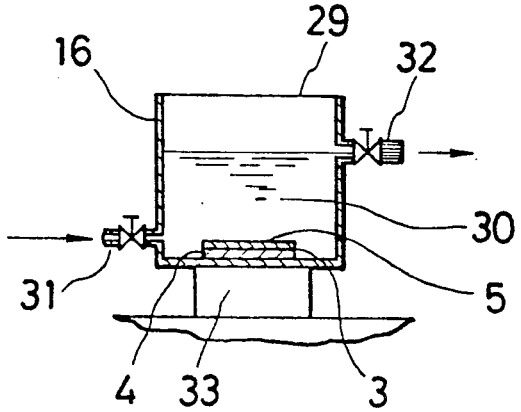
FIG. 4 is an illustration of an apparatus which is employed in a post-decontamination step after the completion of decontamination performed by the apparatus of FIG. 1.

FIG. 4 discloses a decontamination apparatus which makes use of a chelate solution 30. The part 3 decontaminated in the decontamination chamber 1 is further decontaminated by the apparatus 29. The chelate solution 30 is usually circulated through the apparatus 29 by flowing through a chelate solution inlet 31 and a chelate solution outlet 32. Numeral 33 designates a supersonic vibration apparatus which is adapted to vibrate the apparatus 29.

Hitherto, it has been practically difficult to handle methylene chloride solution, due to the fact that no packing material insoluble to methylene chloride has been available. In the present invention, a packing material Carlets (commercial name) produced by Dupont, USA, is used for sealing the methylene chloride solution. The illustrated apparatuses, which produce remarkable decontamination effect, are realized by the use of this packing material.

A description will now be given of an embodiment of the decontamination method which is carried out by using the illustrated apparatuses. As the first step, a part 3 contaminated by a radioactive contaminant is immersed in the methylene chloride solution 7 as shown in FIG. 1. Although not exclusive, the contaminated part 3 shows a contamination degree of 2000 CPM (counts per minutes) in terms of the value measured by a Geiger counter. As stated before, the part 3 carries an epoxy-resin type paint layer as the contaminant 5. As a result of the immersion in the methylene chloride solution, the contaminant 5 is impregnated with the solution so as to swell. The immersion time is, for example, about 20 minutes. The contaminated part 3 is then set in the decontamination chamber 1 as shown in FIG. 1 and is impacted by jets of methylene chloride solution so as to be cleaned. The impacting time, for example, may be about 5 minutes or so. The swelled paint layer is exfoliated as a result of the application of impact. An exfoliation effect which is substantially the same as that performed by the apparatus shown in FIG. 1 can be obtained when the impact is applied while the contaminated part 3 is immersed in the methylene chloride solution 7 as shown in FIG. 3. The level of the radioactivity on the part 3 after the decontamination is about 50 CPM.

The thus decontaminated part is then subjected to a supersonic cleaning which is conducted with the apparatus of FIG. 4 employing a chelate solution. During the cleaning, the chelate solution, containing a surfactant added thereto, is circulated between a tank (not shown) and the apparatus shown in FIG. 4. The radioactivity of the part 3 after this cleaning operation is measured to be 0 CPM. The radio-active contaminated part 3 may be subjected to a pre-treatment such as sand blasting or shot-blasting in advance of the decontamination process described hereinabove.

The methylene chloride solution discharged from the decontamination chamber 1 is introduced into the filter 13 where the contaminant 5 is separated from the solution 7. The methylene chloride solution 7 after the separation of the contaminant 5 is then introduced into the distillation apparatus 18 in which the methylene chloride solution 7 itself is decontaminated through distillation to a degree of 0 CPM. The thus cleaned methylene chloride solution is collected in the second tank 24 and is pressurized by the high-pressure pump 9 so as to be supplied to the nozzle 21 for repeated use.

Decontamination tests were conducted by using the decontamination medium of the present invention, i.e., methylene chloride solution and conventional decontamination mediums, i.e., hydrocarbon fluoride and perchloroethylene, as well as other known chloric solvents. The test was conducted with the decontamination apparatus described before, and the decontamination effects produced by these decontamination mediums were compared. The results are shown in the following Table.

| Solvent | CPM before decontamination | CPM after decontamination | Impregnation time (min) |
|---|---|---|---|
| hydrocarbon fluoride | 2000 | 2000 | 30 |
| perchloroethylene | 2000 | 400 | 30 |
| trichloroethylene | 2000 | 300 | 30 |
| trichloroethane | 2000 | 350 | 30 |
| methylene chloride | 2000 | 50 | 15 |

As will be clear from the Table, methylene chloride offers much superior decontamination effect over conventional decontamination mediums such as hydrocarbon fluoride and perchloroethylene and other known chloric solvents.

Methylene chloride exhibits the lowest level of toxicity among chloric solvents. The maximum allowable concentration of methylene chloride in the air is 500 ppm which is five time as large that of perchloroethylene. Furthermore, methylene chloride has a very low boiling point of 40.4° C. which remarkably reduces the power consumption in the distillation for decontamination of the methylene chloride itself.

The molecular construction of methylene chloride has the highest stability among those of other chloric solvents, so that methylene chloride can be heated and cooled without risk of denaturation, unlike perchloroethylene which is easily denaturated. Methylene chloride also exhibits high stability against ultraviolet rays and solar light rays, in contrast to perchloroethylene, so that it can safely be used for radioactive decontamination without any risk of denaturation by the radioactive rays.

As stated before, it has been practically difficult to handle methylene chloride solution, due to the fact that no packing material insoluble to methylene chloride has been available. In the present invention, a packing material Carlets (commercial name) produced by Dupont, USA, is used for sealing the methylene chloride solution. The illustrated apparatuses, which produce remarkable decontamination effect, are realized by the use of this packing material.

As will be understood from the foregoing description, the present invention provides a decontamination method which offers much superior radioactive decontamination effect as compared with known methods.

In addition, the polluting tendency is much smaller than those of the conventional methods which employ known decontamination mediums such as hydrocarbon fluoride and perchloroethylene.

Furthermore, the cleaning of the decontamination medium itself can be conducted with electric power which is much smaller than that required in the conventional methods, whereby a high decontamination efficiency is attained.

The methylene chloride used as the decontamination medium in the present invention exhibits a much higher stability of molecular construction than those of perchloroethylene and other known decontamination mediums and, hence, can be distilled without any denaturation which tends to occur when perchloroethylene and other mediums are heated and cooled for distillation cleaning. Methylene chloride also exhibits a high stability against ultraviolet rays and solar light rays, in contrast to perchloroethylene, so that it can safely be used for radioactive decontamination without any risk of denaturation by the radioactive rays.

What is claimed is:

1. A radioactive decontamination method using methylene chloride, comprising the steps of: cleaning a radioactive-contaminated object with a methylene chloride solution so as to remove contaminant from the surface of said object thereby decontaminating said object; filtering the methylene chloride solution containing said contaminant so as to separate said contaminant from said methylene chloride solution; distilling said methylene chloride solution after separation of said contaminant so as to separate any contaminant which has still been dissolved in said methylene chloride solution, thereby decontaminating said methylene chloride solution itself; and subjecting the decontaminated methylene chloride solution to repeated use for cleaning said object.

2. A radioactive decontamination method using methylene chloride, comprising the steps of: cleaning a radioactive-contaminated object with a methylene chloride solution so as to remove contaminant from the surface of said object thereby decontaminating said object; further decontaminating said object using a chelate solution; filtering the methylene chloride solution containing said contaminant so as to separate said contaminant from said methylene chloride solution; distilling said methylene chloride solution after separation of said contaminant so as to separate any contaminant which has still been dissolved in said methylene chloride solution, thereby decontaminating said methylene chloride solution itself; and subjecting the decontaminated methylene chloride solution to repeated use for cleaning said object.

3. A radioactive decontamination method using methylene chloride, comprising the steps of: immersing a radioactive-contaminated object in a methylene chloride solution so as to impregnate contaminant on the surface of said object with said methylene chloride solution; cleaning said object with said methylene chloride solution so as to remove said contaminant from the surface of said object thereby decontaminating said object; filtering the methylene chloride solution containing said contaminant so as to separate said contaminant from said methylene chloride solution; distilling said methylene chloride solution after separation of said contaminant so as to separate any contaminant which has still been dissolved in said methylene chloride solution, thereby decontaminating said methylene chloride solution itself; and subjecting the decontaminated methylene chloride solution to repeated use for cleaning said object.

4. A radioactive decontamination method using methylene chloride, comprising the steps of: immersing a radioactive-contaminated object in a methylene chloride solution so as to impregnate contaminant on the surface of said object with said methylene chloride solution; cleaning said object with said methylene chloride solution so as to remove contaminants from the surface of said object thereby decontaminating said object; further decontaminating said object using a chelate solution; filtering the methylene chloride solution containing said contaminant so as to separate said contaminant from said methylene chloride solution; distilling said methylene chloride solution after separation of said contaminant so as to separate any contaminant which has still been dissolved in said methylene chloride solution, thereby decontaminating said methylene chloride solution itself; and subjecting the decontaminated methylene chloride solution to repeated use for cleaning said object.

5. A radioactive decontamination method using methylene chloride, according to claim 1, wherein the cleaning of said object with said methylene chloride solution is effected by impacting said object with said methylene chloride solution.

6. A radioactive decontamination method using methylene chloride, according to claim 5, wherein the impact by said methylene chloride solution is conducted while said object is held in the air.

7. A radioactive decontamination method using methylene chloride, according to claim 5, wherein the impact by said methylene chloride solution is conducted while said object is immersed in said methylene chloride solution.

8. A radioactive decontamination method using methylene chloride, according to claim 1, wherein said object is subjected beforehand to at least one selected from the group of sand-blasting and shot-blasting.

9. A radioactive decontamination method using methylene chloride, according to claim 1, wherein said object is subjected beforehand to a sand-blasting or a shot-blasting.

10. A radioactive decontamination method using methylene chloride, according to claim 2, wherein the cleaning of said object with said methylene chloride solution is effected by impacting said object with said methylene chloride solution.

11. A radioactive decontamination method using methylene chloride, according to claim 3, wherein the cleaning of said object with said methylene chloride solution is effected by impacting said object with said methylene chloride solution.

12. A radioactive decontamination method using methylene chloride, according to claim 4, wherein the cleaning of said object with said methylene chloride solution is effected by impacting said object with said methylene chloride solution.

13. A radioactive decontamination method using methylene chloride according to claim 4, wherein said chelate solution is vibrated by a supersonic vibration device.

14. A radioactive decontamination method using methylene chloride according to claim 2, wherein said object is subjected beforehand to at least one selected from the group of sandblasting and shotblasting.

15. A radioactive decontamination method using methylene chloride according to claim 3, wherein said object is subjected beforehand to sandblasting or shotblasting.

16. A radioactive decontamination method using methylene chloride, according to claim 4, wherein said object is subjected beforehand to sandblasting or shotblasting.

* * * * *